US006162118A

United States Patent [19]

Arts et al.

[11] Patent Number: 6,162,118

[45] Date of Patent: Dec. 19, 2000

[54] PORTABLE ISOLATION DEVICE AND METHOD

[75] Inventors: Theodore A. M. Arts, 21 Countryside La., Williamsville, N.Y. 14221; James M. Thomsen, North Tonawanda, N.Y.

[73] Assignee: Theodore A. M. Arts, Williamsville, N.Y.

[21] Appl. No.: 09/454,444

[22] Filed: Dec. 3, 1999

Related U.S. Application Data

[60] Provisional application No. 60/111,121, Dec. 4, 1998.

[51] Int. Cl.[7] ..... F24F 7/00; B08B 15/02

[52] U.S. Cl. ..... 454/49; 135/93; 160/117; 454/56; 454/187; 454/341; 600/21

[58] Field of Search ..... 454/49, 56, 57, 454/187, 253, 341; 160/127, 117; 135/93, 94; 600/21

[56] References Cited

U.S. PATENT DOCUMENTS

| | | | |
|---|---|---|---|
| 306,390 | 10/1884 | Fahrney . | |
| 1,669,683 | 5/1928 | Temple et al. | 454/49 X |
| 1,977,386 | 10/1934 | Holes | 454/56 |
| 2,694,403 | 11/1954 | Hudson . | |
| 2,737,695 | 3/1956 | Sokolik . | |
| 5,056,422 | 10/1991 | Horntvedt . | |
| 5,314,377 | 5/1994 | Pelosi, III | 454/187 |
| 5,464,029 | 11/1995 | Rentz | 454/56 X |

FOREIGN PATENT DOCUMENTS

| | | | |
|---|---|---|---|
| 22214 | 11/1905 | Austria | 454/56 |

*Primary Examiner*—Harold Joyce
*Attorney, Agent, or Firm*—Hodgson Russ Andrews Woods & Goodyear LLP

[57] ABSTRACT

An isolation device has a movable frame and a barrier mounted on the frame. The barrier partially encloses a space to be occupied by a patient. The device also includes an air conducting unit having a primary duct attached to the barrier such that air can be conducted between the partially enclosed space and an outside location through the primary duct. Attached to the primary duct is a means for moving air between the partially enclosed space and the outside location.

The present invention also includes a method of isolating a patient that begins by providing an isolating device according to the present invention. Air is conducted between the partially enclosed space and the outside location through the primary duct using the means for moving air, and a patient is positioned in the partially enclosed space.

15 Claims, 7 Drawing Sheets

FIG. 3
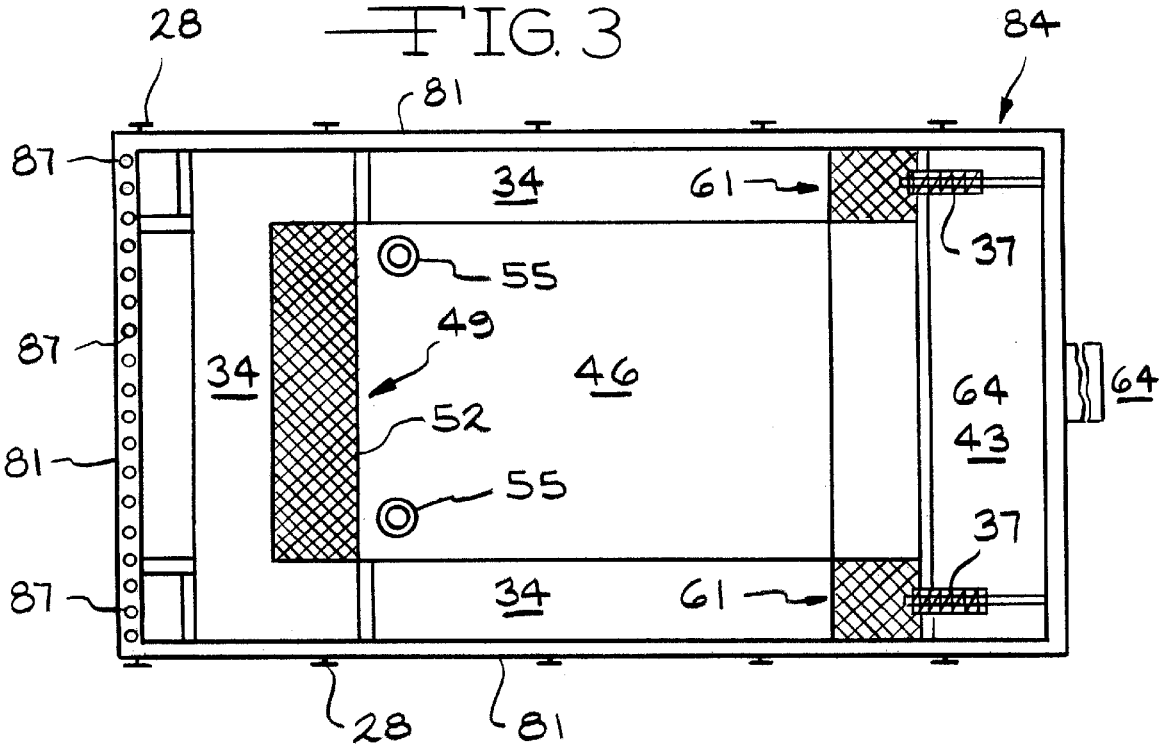
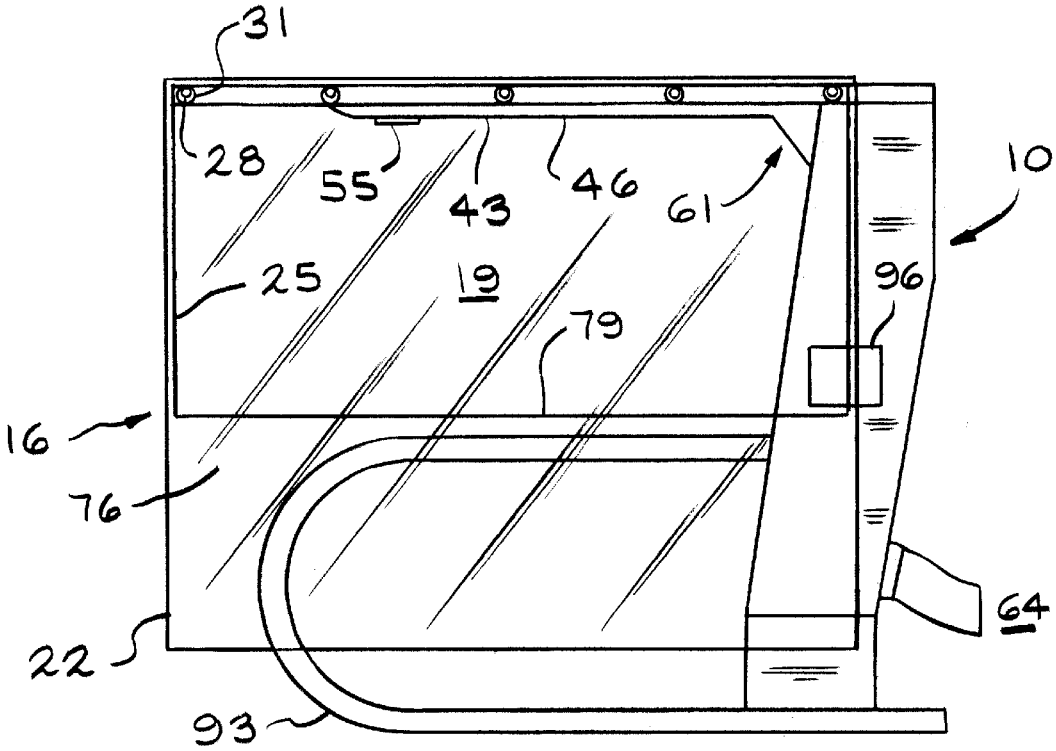
FIG. 4

PORTABLE ISOLATION DEVICE AND METHOD

CROSS-REFERENCE TO RELATED APPLICATION

This application claims priority to an earlier filed U.S. provisional patent application, U.S. provisional patent application Ser. No. 60/111,121, which was filed on Dec. 4, 1998, and is incorporated herein by reference.

BACKGROUND OF THE INVENTION

1. Field of the Invention

The present invention relates generally to devices and methods for controlling airborne contaminates. More specifically the present invention is an isolation device and method for isolating a human being.

2. Discussion of Related Art

In the prior art, there are devices and methods for isolating a human being. In one such device, a patient isolation room has walls surrounding a relatively smaller patient locus, with a continuous air flow loop including an air inlet and outlet relatively sized and oppositely arranged to encompass the patient locus on every side with a horizontal, unidirectional, laminar air stream of uniform velocity throughout its cross-section to maintain patient isolation from room air beyond the locus. The loop conducts depurified air beyond the room for recirculation and repurification.

The prior art devices do not provide a device or method of isolating a human being using an existing patient care area to provide protection from infection. Furthermore, the prior art devices are difficult to sterilize.

SUMMARY OF THE INVENTION

Accordingly, it is an object of the present invention to provide a device and method for isolating at least part of a human being to control the spread of infectious disease.

It is also an object of the present invention to provide a method for isolating at lease part of a human being to prevent the spread of infectious disease.

The foregoing objectives are realized by an isolation device having a movable frame and a barrier mounted on the frame. The barrier partially encloses a space to be occupied by a patient. The device also includes an air conducting unit having a primary duct attached to the barrier such that air can be conducted between the partially enclosed space and an outside location through the primary duct. Attached to the primary duct is a means for moving air between the partially enclosed space and the outside location.

The present invention also includes a method of isolating a patient that begins by providing an isolating device according to the present invention. Air is conducted between the partially enclosed space and the outside location through the primary duct using the means for moving air, and a patient is positioned in the partially enclosed space.

BRIEF DESCRIPTION OF THE DRAWINGS

For a fuller understanding of the nature and objects of the invention, reference should be made to the following detailed description taken in conjunction with the accompanying drawings, in which:

FIG. 3 is a cross-sectional view of the device shown in FIG. 1 taken along the line 3—3;

FIG. 4 is a side view of an alternative embodiment of a device according to the present invention;

BEST MODE FOR CARRYING OUT THE INVENTION

Figure 1:
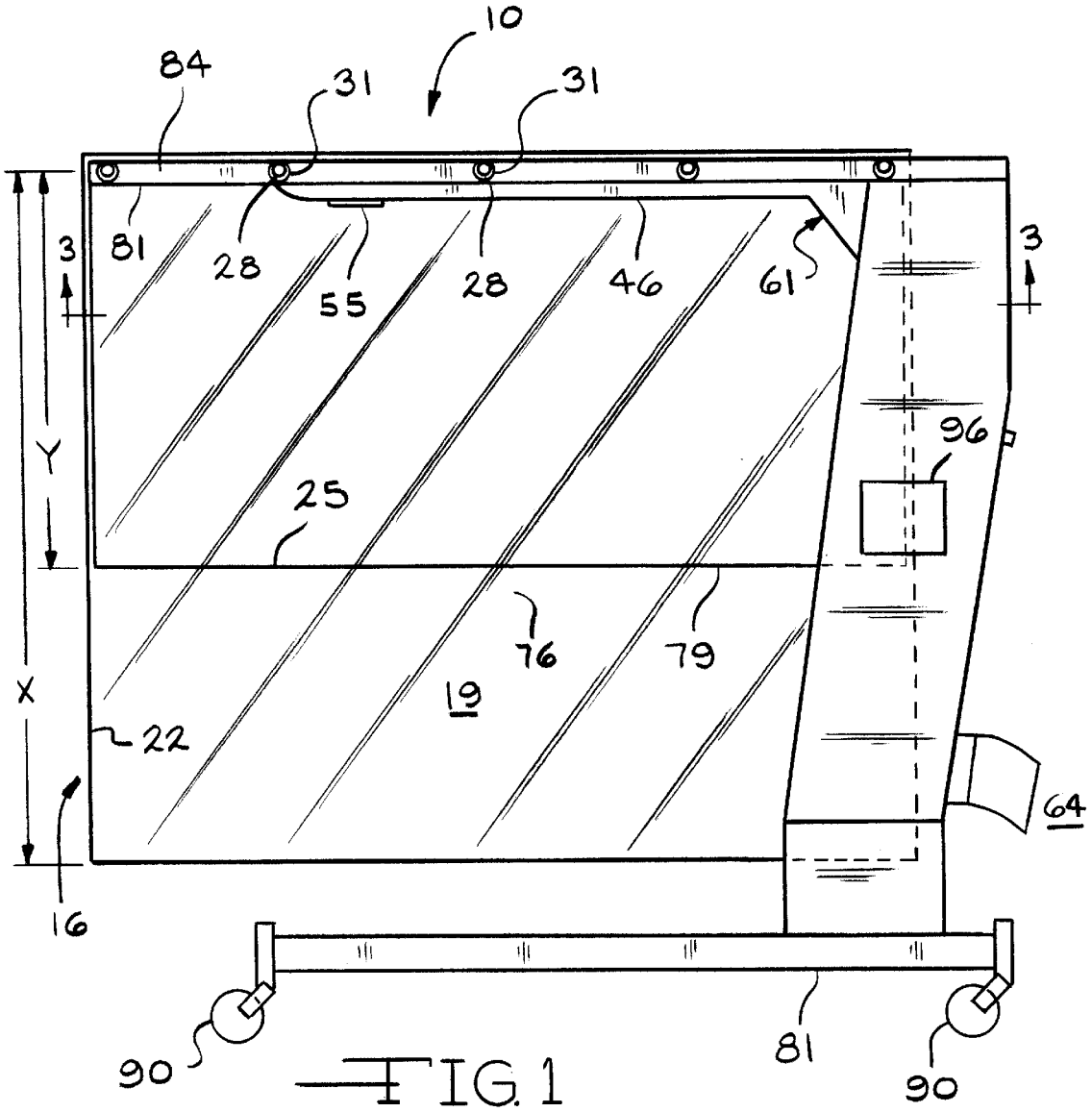
FIG. 1 is a side view of a device according to the present invention.
Figure 2:
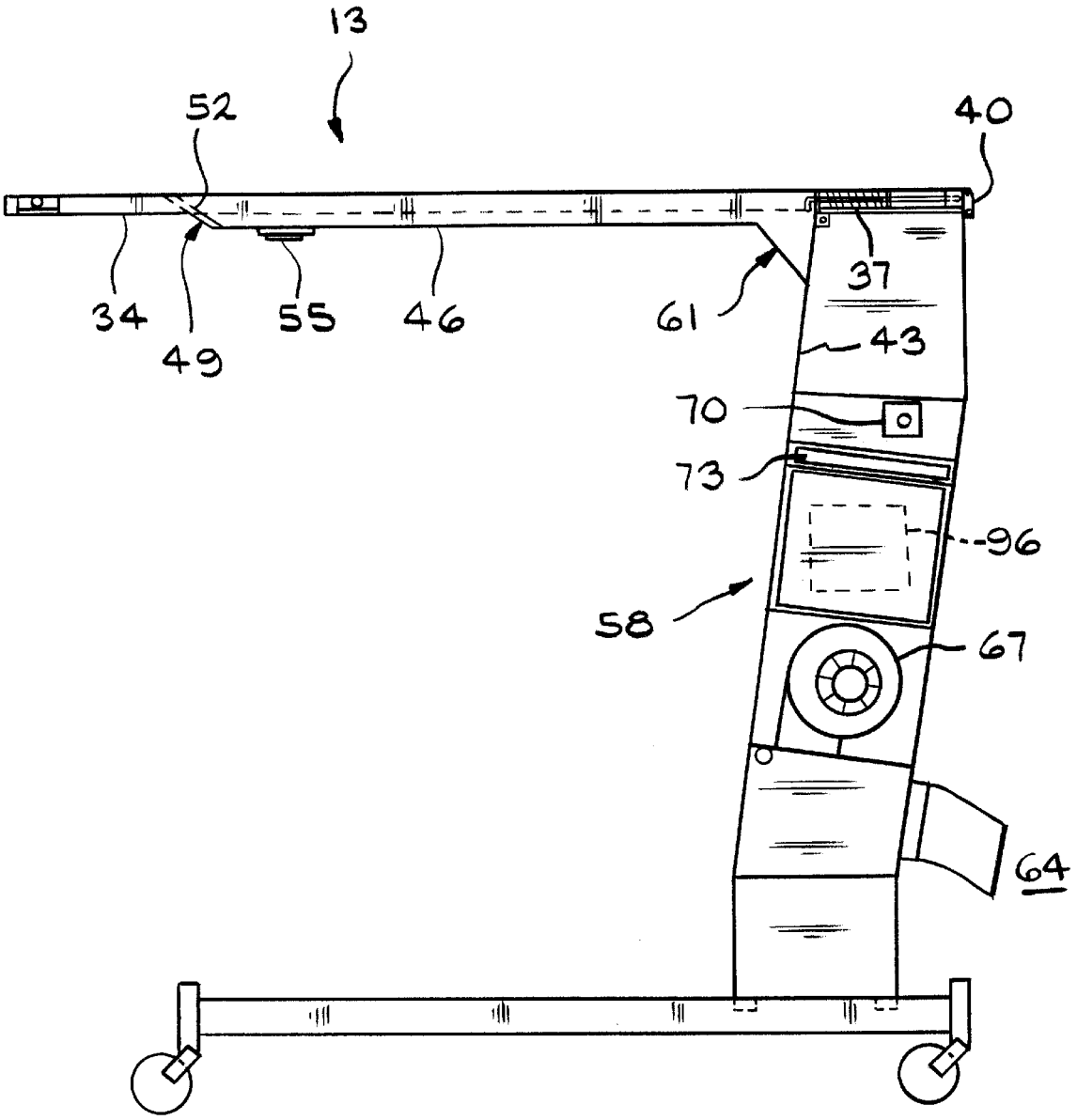
FIG. 2 is a side view of the device shown in FIG. 1 with a portion of a duct and frame removed.

FIGS. 1 through 3 show an isolation device 10 according to the present invention. The isolation device 10 has a movable frame 13 and a barrier 16 mounted on the frame 13 and partially enclosing a space 19 (herein referred to as the "partially enclosed space"). The barrier 16 may have one or more substantially translucent flexible outer walls 22 and one or more substantially translucent flexible inner walls 25. In a preferred embodiment of the isolation device 10, the flexible outer walls 22 extend from the retainer pegs 28 a first distance X, and the flexible inner walls 25 extend from the retainer pegs 28 a second distance Y, the distance X being greater than the distance Y. In a preferred embodiment of the present invention, the distance X is 54 inches and the thickness of the outer walls 22 is 0.02 inches, and the distance Y is 24 inches and the thickness of the inner walls 25 is 0.04 inches. In this preferred embodiment, the inner walls 25 are made of thicker material so that they are not easily moved, and the outer walls 22 are made of thinner material so that they are easily moved. In this fashion, a health care professional can move an outer wall 22 aside and reach under the inner wall 25 to gain access to the patient in the partially enclosed space 19 while being protected by the inner wall 25 from disease carrying objects within the partially enclosed space 19.

A suitable material for the substantially translucent flexible walls 22, 25 is polyvinyl chloride. In a preferred embodiment of the present invention, either the inner walls 25 or the outer walls 22, or both, are made from a polyvinyl chloride material having an anti-static component. The anti-static component prevents the inadvertent movement of an inner wall 25 by, for example, a health care professional moving an outer wall 22 to gain access to the patient.

When the barrier 16 includes substantially translucent flexible walls 22, 25, the frame 13 is preferably provided with a means for hanging the flexible walls 22, 25 from the frame 13. The means for hanging may be a series of retainer pegs 28 for extending through corresponding wall holes 31 in the flexible walls 22, 25. In this fashion, the flexible walls 22, 25 are easily hung from the retainer pegs 28.

The barrier 16 also preferably has a rigid panel 34 that may be a sheet of aluminum. The rigid panel 34 serves to protect the patient from falling objects and may be used to mount lights for reading or examining the patient. The rigid panel 34 may be connected to the frame 13 via a spring loaded top lock 37 (shown in FIGS. 2 and 3) and safety catch 40 that together permit the rigid panel 34 to be locked in the extended position as shown in FIGS. 1 through 3, or alternatively folded down against the primary duct 43. In a preferred embodiment of the invention, the rigid panel 34 forms one side of an overhanging duct 46 having a distal opening 49 covered with a lint trapping grill 52 for delivering air to or receiving air from the partially enclosed space 19. Reading or examination lights 55 may be attached to the overhanging duct 46, instead of or in addition to the rigid panel 34.

The isolation device 10 also has an air conducting unit 58 having a primary duct 43 attached to the barrier 16 by, for example, the overhanging duct 46 and secondary ducts 61 having grills 52 such that air can be conducted between the partially enclosed space 19 and a location outside the partially enclosed space (herein referred to as the "outside location") 64 through the primary duct 43. The air conducting unit 58 shown in FIG. 2 also has a means for moving air 67 between the partially enclosed space 19 and the outside location 64. The means for moving air 67 may be a fan attached to the primary duct 43. In a preferred embodiment of the isolation device 10, the fan is of a type used in explosive environments, such as model number 5C508 distributed by Granger Industrial Supplies located in Chicago, Ill.

As shown in FIG. 2, the isolation device 10 may include an ultra violet (sometimes referred to herein as "UV") light source 70 for providing ultra violet light to the interior portion of the primary duct 43. Also shown in FIG. 2 is an air filter 73 in the primary duct 43. The air filter 73 is preferably located between the grills 52 and the means for moving air 67 in order to capture disease carrying objects. A suitable air filter 73 is a high efficiency particulate air ("HEPA") filter capable of capturing at least about 99.97% of 0.3 micron matter at 550 cubic feet per minute, such as model 6B616 distributed by Granger Industrial Supplies located in Chicago, Ill. A preferred air filter 73 is capable of capturing at least about 99.99% of 0.3 micron matter at 750 cubic feet per minute, such as a Filtra 2000, part no. 5010005, manufactured by Filtra Inc. of Riverdale, N.J. When both the UV light source 70 and the air filter 73 are provided, it is preferred that the UV light source 70 be oriented such that UV light emitted from the UV light source 70 is directed at the air filter 73.

In order to provide adequate protection from spreading infectious disease, the means for moving air 67 is preferably sized to move about 600 cubic feet of air per minute. In addition, the barrier 16, the frame 13 and the means for moving air 67 are sized to provide an air velocity of at least about 175 feet per minute when a portion of the barrier 16 is removed to permit access to the patient by a health care professional. For example, in the preferred embodiment of the present invention described above, when approximately one-third of the outer wall 22 is moved aside, the velocity of the air is about 200 feet per minute moving into the partially enclosed space 19 at a location 76 near an edge 79 of the inner wall 25 formerly occupied by the outer wall 22. It is believed such a velocity will prevent transmission of infectious disease from the patient to the health care professional.

It should be noted that the means for moving air 67 may be capable of moving the air from the partially enclosed space 19 to the outside location 64 so that disease carrying objects emitted from the patient are captured by the air conducting unit 58. It is intended that when the means for moving air 67 moves air from the partially enclosed space 19 to the outside location 64, the air is treated to prevent the spread of disease to individuals occupying the outside location 64, or alternatively, the outside location 64 is not occupied by individuals susceptible to disease.

Alternatively, the means for moving air 67 may be capable of moving air from the outside location 64 to the partially enclosed space 19, and through a treatment system, such as the air filter 73 and UV light source 70 described above, in order to prevent disease carrying objects from infecting the patient.

In the preferred embodiment of the present invention, the frame 13 is comprised of tubular members 81. One advantage of using tubular members 81 in the frame 13 is that weight is minimized, and therefore, the isolation device 10 is more easily moved from one location to another. In one such embodiment of the present invention, a tubular member 81 is used to make the top portion 84 of the frame 13, and this tubular member 81 has a plurality of tube holes 87 through the tubular member 81. When such a tubular member 81 is provided, the primary duct 43 may be connected to the tubular member 81 such that air can be conducted between the partially enclosed space 19 and the outside location 64 through the tube holes 87, the tubular member 81 and the primary duct 43. If enough tube holes 87 are provided in the tubular member 81, portions of the barrier 16 may be omitted because air emitted from the tube holes 87 provides protection against disease carrying objects entering the partially enclosed space.

The isolation device 10 of the present invention may include at least one wheel 90 or skid bar 93 (FIG. 4) mounted on the frame 13 for supporting the frame 13 during movement of the isolation device 10. Preferably, the isolation device 10 has four wheels 90 that are selectively lockable.

Figure 5:
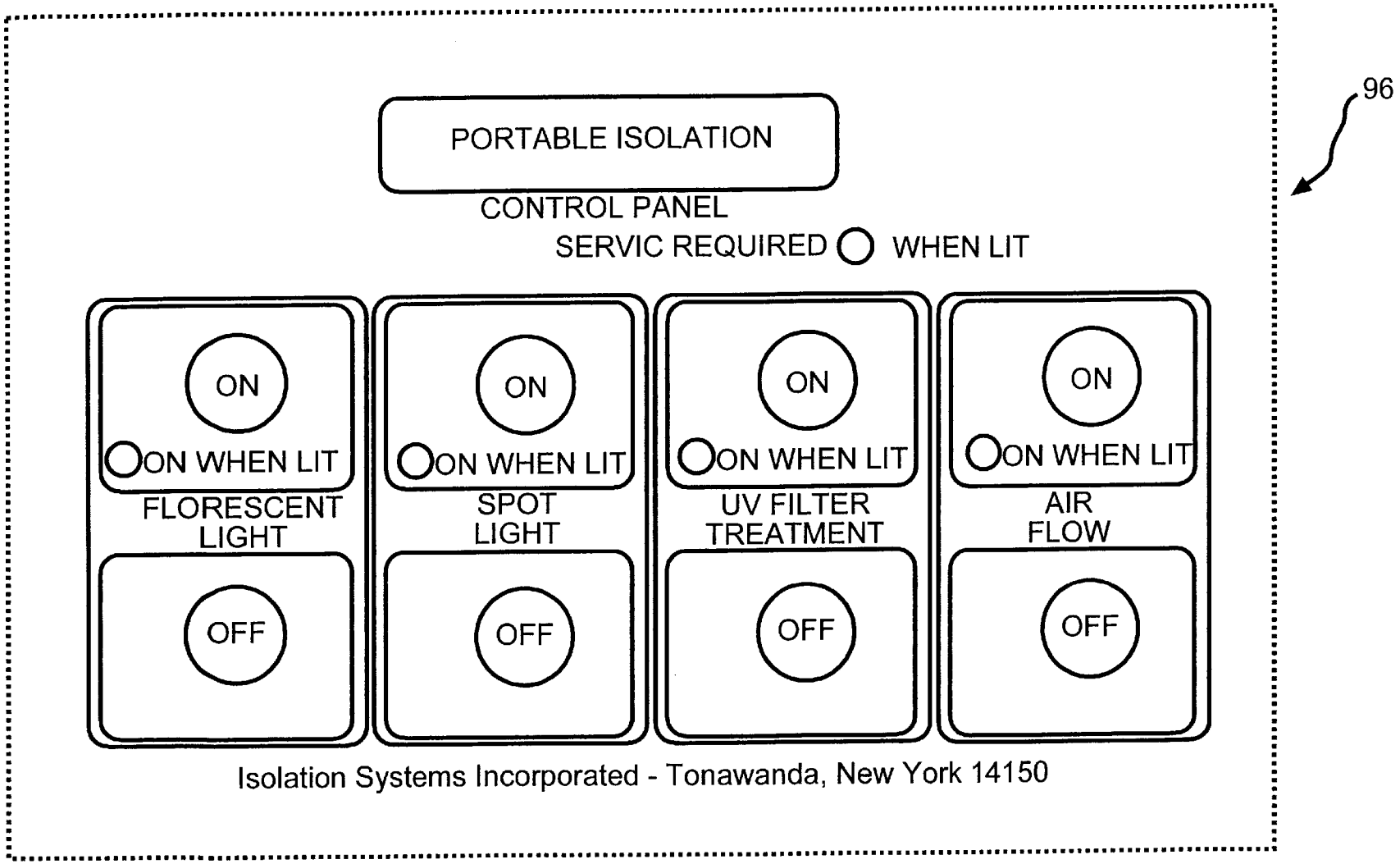
FIG. 5 shows a control panel that can be used in a device according to the present invention.
Figure 6:
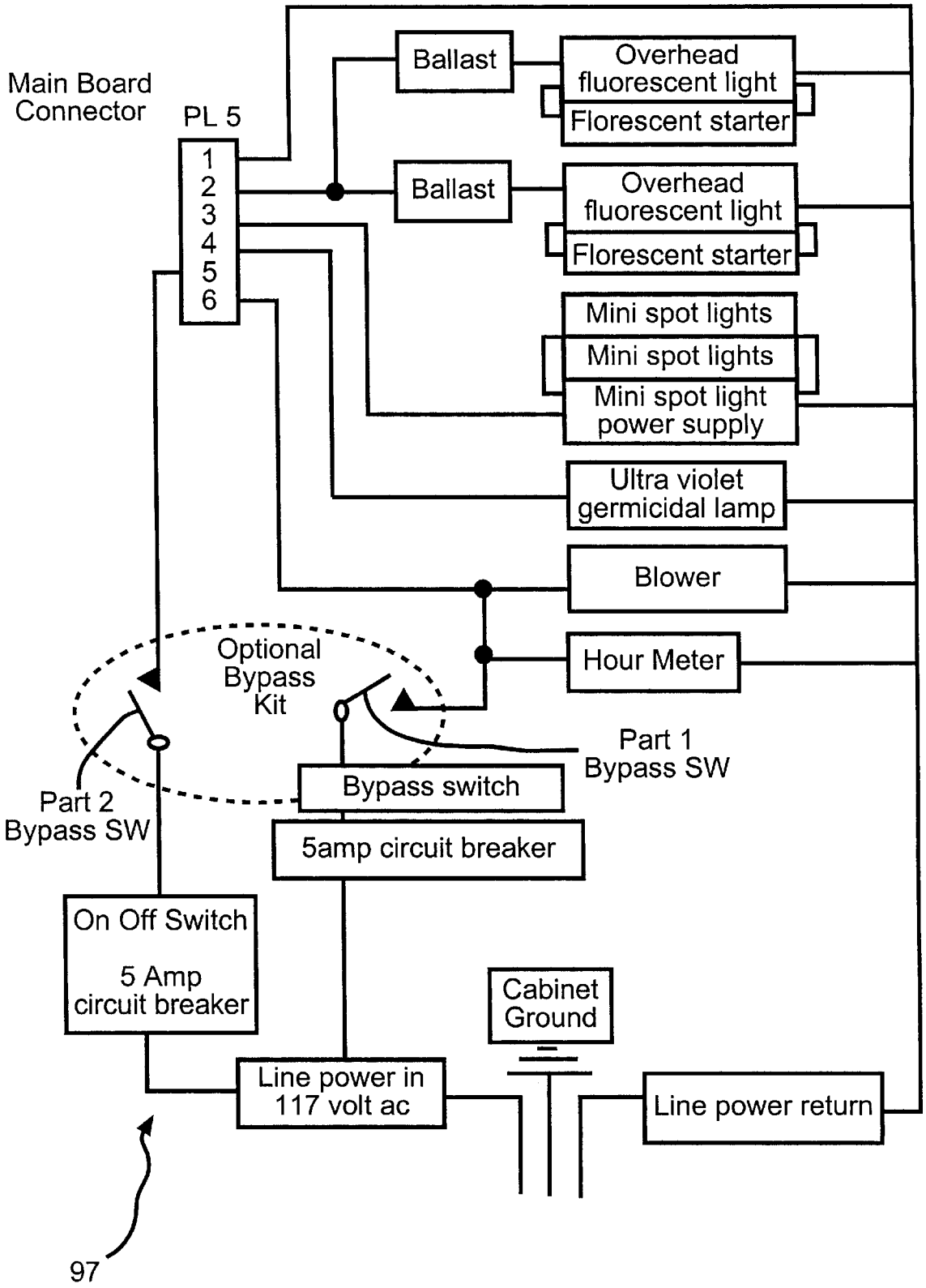
FIG. 6 is a circuit diagram of circuits used in an embodiment of a device according to the present invention.

To further accommodate movement of the isolation device 10, the present invention preferably has two control panels 96. The face plate of a representative control panel 96 is shown in FIG. 5, and FIG. 6 shows a general circuit diagram 97 showing how a representative control panel 96 permits control of devices incorporated into the isolation device 10. The control panels 96 are mounted on the isolation device 10 such that if one of the control panels 96 is placed close to a wall, the other control panel 96 will not likely be obstructed by, for example, an adjoining wall. In this manner, the isolation device 10 may be moved to a particular location without access to the control panel 96 being an issue.

Figure 7:
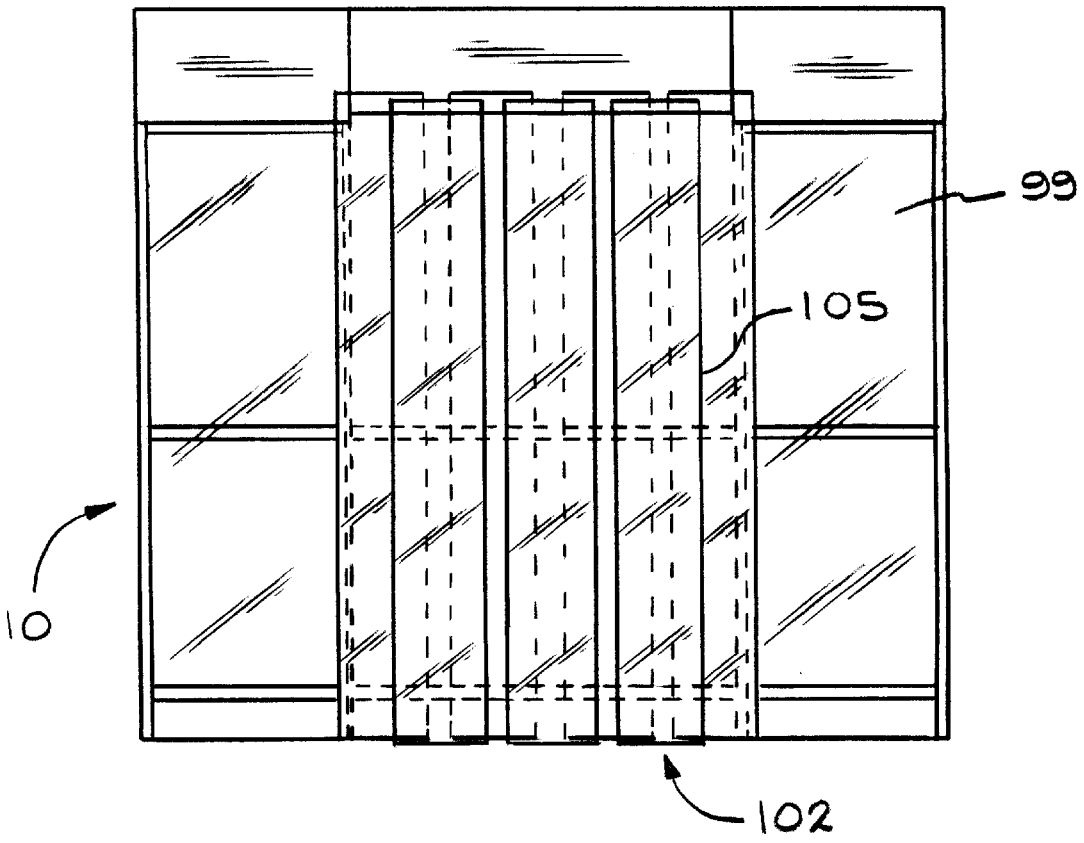
FIG. 7 is a side view of an alternative embodiment of a device according to the present invention.
Figure 8:
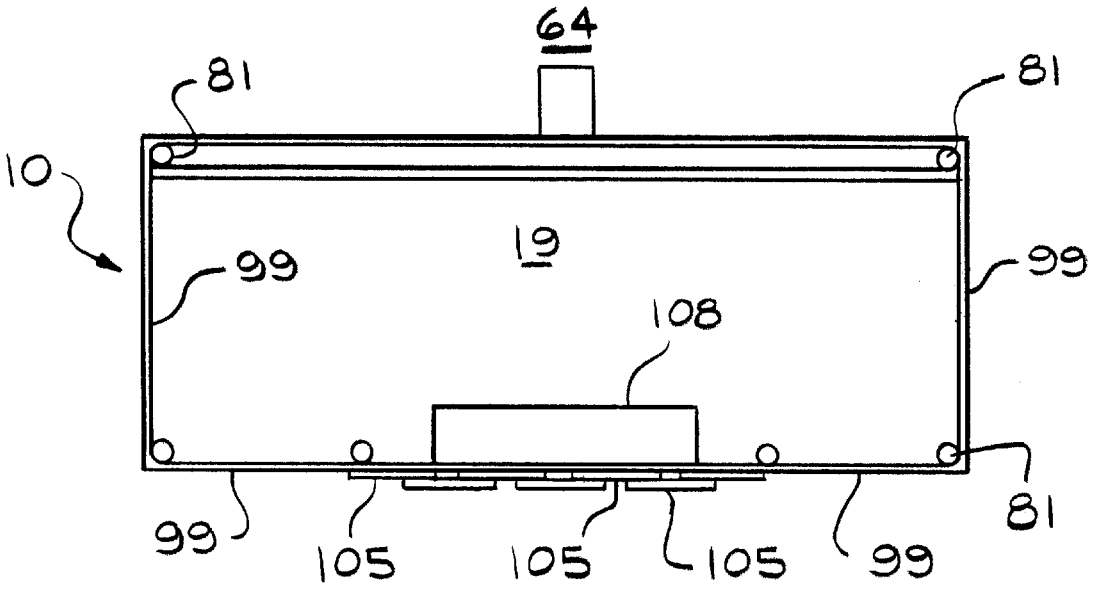
FIG. 8 is a plan view of the device shown in FIG. 7.

FIGS. 7 and 8 show another embodiment of the barrier 16 according to the present invention. In this embodiment, the barrier 16 includes translucent plexiglass panels 99 arranged to define the partially enclosed space 19. An entrance 102 is provided in the plexiglass panels 99 and substantially covered by translucent flexible strips 105 hanging from a portion of one of the panels 99. At least one edge of each strip 105 overlaps an adjacent edge of another strip 105. The panels 99 may be mounted on a frame 13 having tubular members 81. Preferably, a primary duct opening 108 is provided near the entrance 102.

Figure 9:
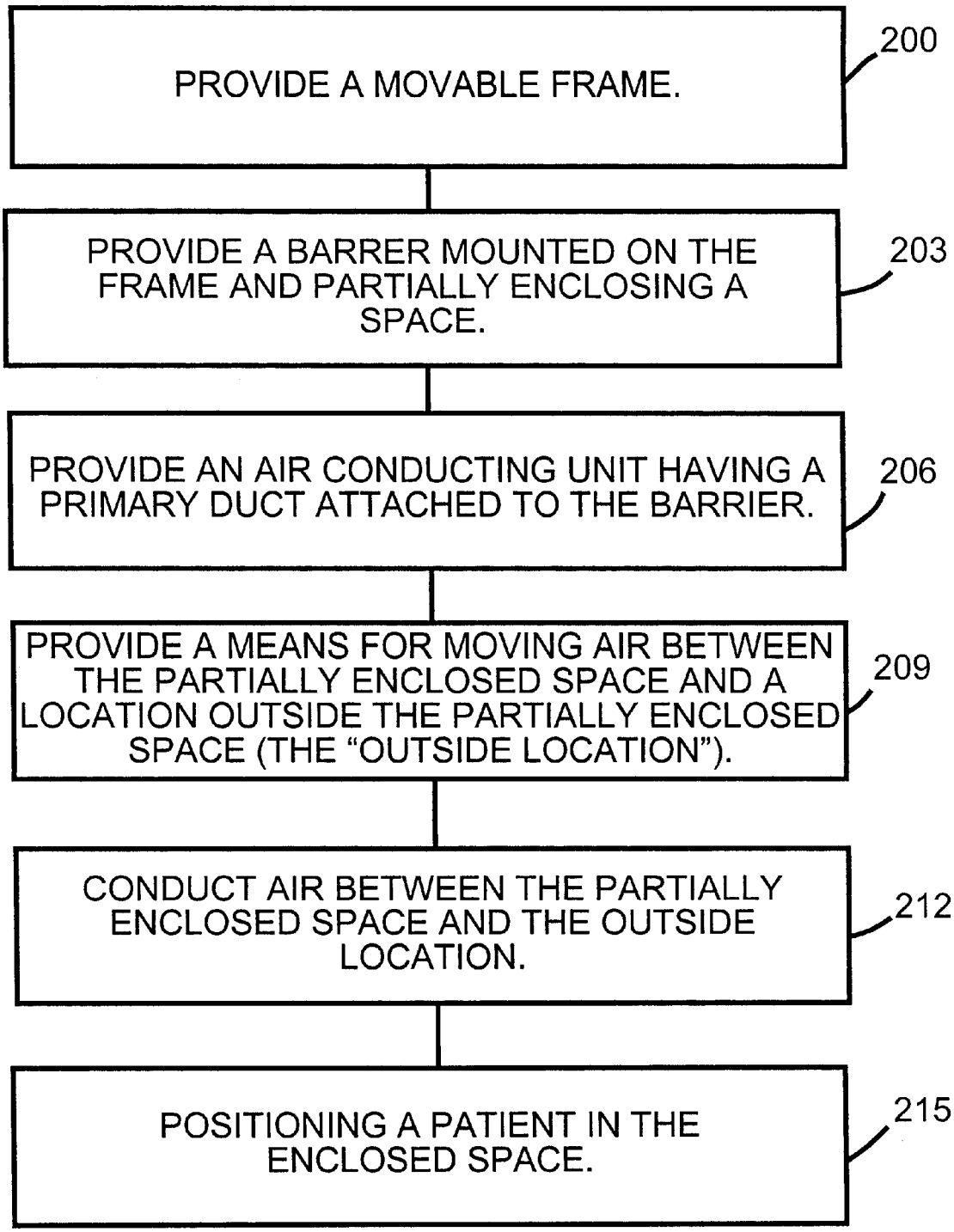
FIG. 9 shows steps of a method according to the present invention.

FIG. 9 shows steps of a method according to the present invention. The method has the steps of providing a movable frame (step 200), providing a barrier (step 203) mounted on the frame and partially enclosing a space, providing an air conducting unit (step 206) having a primary duct attached to the barrier such that air can be conducted between the partially enclosed space and a location outside the partially enclosed space through the primary duct, and providing a means for moving air (step 209) between the partially enclosed space and a location outside the partially enclosed space, the means for moving air being attached to the primary duct. Then, air is conducted (step 212) between the partially enclosed space and a location outside the partially enclosed space through the primary duct using the means for moving air and a patient is positioned (step 215) in the partially enclosed space.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. An isolation device, comprising:

a movable frame;

a barrier mounted on the frame and partially enclosing a space, the barrier includes a first outer wall and a second inner wall, and wherein the first outer wall and the second inner wall are attached to the frame, the outer wall extending from the frame a first distance and the inner wall extending from the frame a second distance, the first distance being greater than the second distance;

an air conducting unit having a primary duct attached to the barrier such that air can be conducted between the partially enclosed space and a location outside the partially enclosed space through the primary duct, and further having a means for moving air between the partially enclosed space and a location outside the partially enclosed space, the means for moving air being attached to the primary duct.

2. The isolation device of claim 1, wherein the barrier includes substantially translucent flexible walls.

3. The isolation device of claim 2, wherein the barrier and the means for moving air are sized to provide an air velocity of at least about 175 feet per minute when approximately one-third of the outer wall is removed, the air velocity being measured at a location near an edge of the second inner wall.

4. The isolation device of claim 2, wherein the substantially translucent flexible walls include polyvinyl chloride.

5. The isolation device of claim 1, wherein the barrier includes a rigid panel.

6. The isolation device of claim 5, wherein the rigid panel includes aluminum.

7. The isolation device of claim 1 further comprising an ultra violet light source for providing ultra violet light to air conducted through the primary duct.

8. The isolation device of claim 1, wherein the frame is comprised of tubular members.

9. The isolation device of claim 1 further comprising an air filter in the primary duct.

10. The isolation device of claim 9, wherein the air filter is located between the partially enclosed space and the means for moving air.

11. The isolation device of claim 9, further comprising an ultraviolet light source for providing ultra violet light to the air filter.

12. The isolation device of claim 1, wherein the means for moving air is capable of moving air from the partially enclosed space to the location outside the partially enclosed space.

13. The isolation device of claim 1, wherein the means for moving air is capable of moving air from the location outside the partially enclosed space to the partially enclosed space.

14. The isolation device of claim 1, further comprising at least one wheel mounted on the frame for supporting the frame during movement of the isolation device.

15. The isolation device of claim 1, wherein the barrier includes plexiglass walls having an entrance therein, the entrance being substantially covered by overlapping flexible strips.

* * * * *